US012613044B1

(12) United States Patent
Leonard

(10) Patent No.: US 12,613,044 B1
(45) **Date of Patent: *Apr. 28, 2026**

(54) ROOF VENT

(71) Applicant: Jonathan Leonard, Fort Meyers, FL (US)

(72) Inventor: Jonathan Leonard, Fort Meyers, FL (US)

( * ) Notice: Subject to any disclaimer, the term of this patent is extended or adjusted under 35 U.S.C. 154(b) by 488 days.

This patent is subject to a terminal disclaimer.

(21) Appl. No.: 17/860,431

(22) Filed: Jul. 8, 2022

Related U.S. Application Data

(63) Continuation-in-part of application No. 17/725,646, filed on Apr. 21, 2022, now abandoned.

(51) Int. Cl.
*E04D 13/03* (2006.01)
*F24F 7/02* (2006.01)

(52) U.S. Cl.
CPC ..... *F24F 7/02* (2013.01); *E04D 13/0325* (2013.01)

(58) Field of Classification Search
CPC ..... F24F 13/08; F24F 13/082; F24F 13/10; F24F 13/1486
USPC ..... 403/116
See application file for complete search history.

(56) References Cited

U.S. PATENT DOCUMENTS

| | | | | |
|---|---|---|---|---|
| 5,085,132 | A * | 2/1992 | Ikeda | F24F 13/08 454/158 |
| 5,632,678 | A * | 5/1997 | Doelfel | F24F 7/02 454/366 |
| 5,803,805 | A * | 9/1998 | Sells | E04D 13/174 454/364 |
| 6,315,154 | B1 * | 11/2001 | Newby, Sr. | E05D 5/125 220/4.23 |
| 6,994,622 | B2 * | 2/2006 | Koessler | F24F 7/02 454/367 |
| 9,080,779 | B1 * | 7/2015 | Leonard | F24F 7/02 |
| 2005/0003755 | A1 * | 1/2005 | Koessler | F24F 13/08 454/359 |

* cited by examiner

*Primary Examiner* — Jessica L Laux
(74) *Attorney, Agent, or Firm* — Edward P Dutkiewicz P.A.

(57) ABSTRACT

A base having an air passageway there through, coupled to a stack having a pair of side walls and rear wall and a forward wall forming an air passageway. The stack is coupled to the base, and a dome being coupled to the stack. The dome has an air passageway there through. the dome having a plurality of hinge holes there through. The roof vent has a flap b which is rotatably coupled to the dome. The flap has a plurality of hinges which couple the flap to the dome.

10 Claims, 12 Drawing Sheets

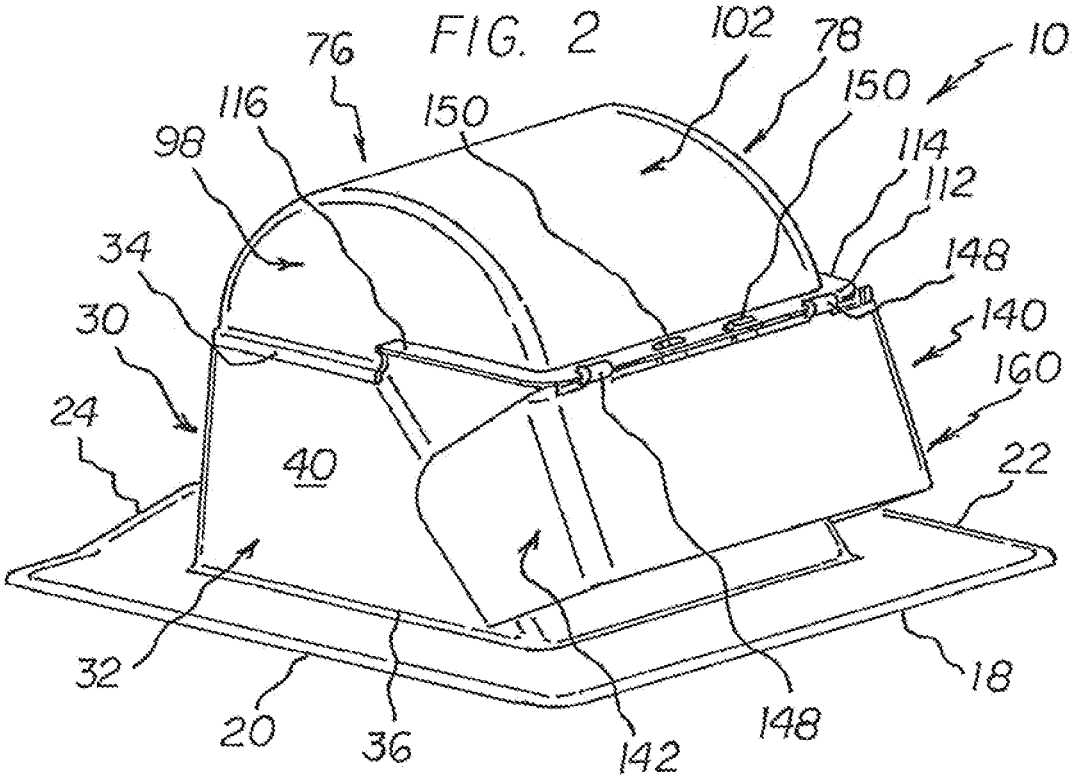
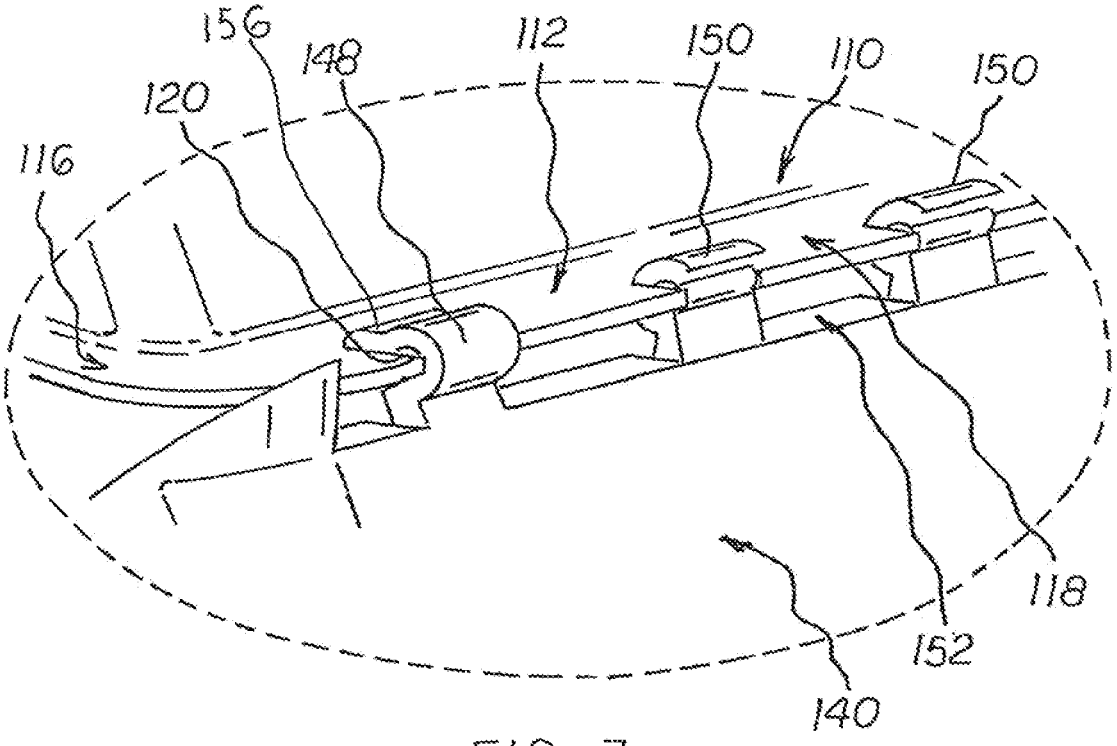
FIG. 3

FIG. 6
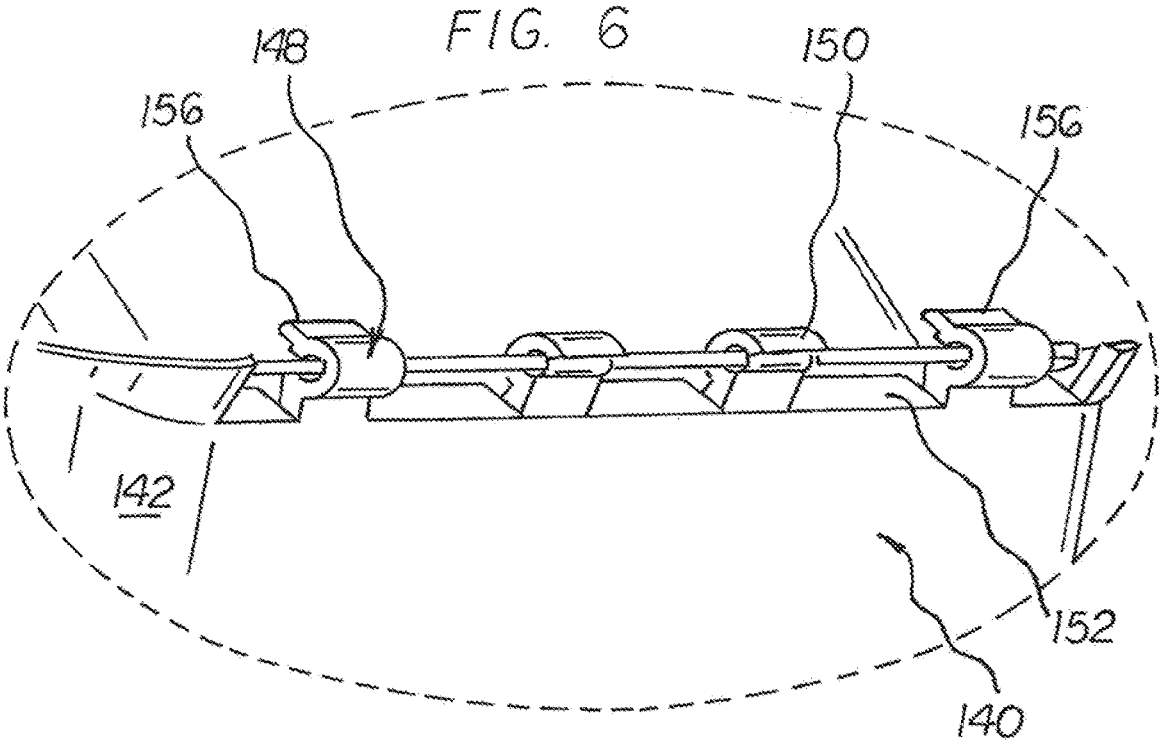
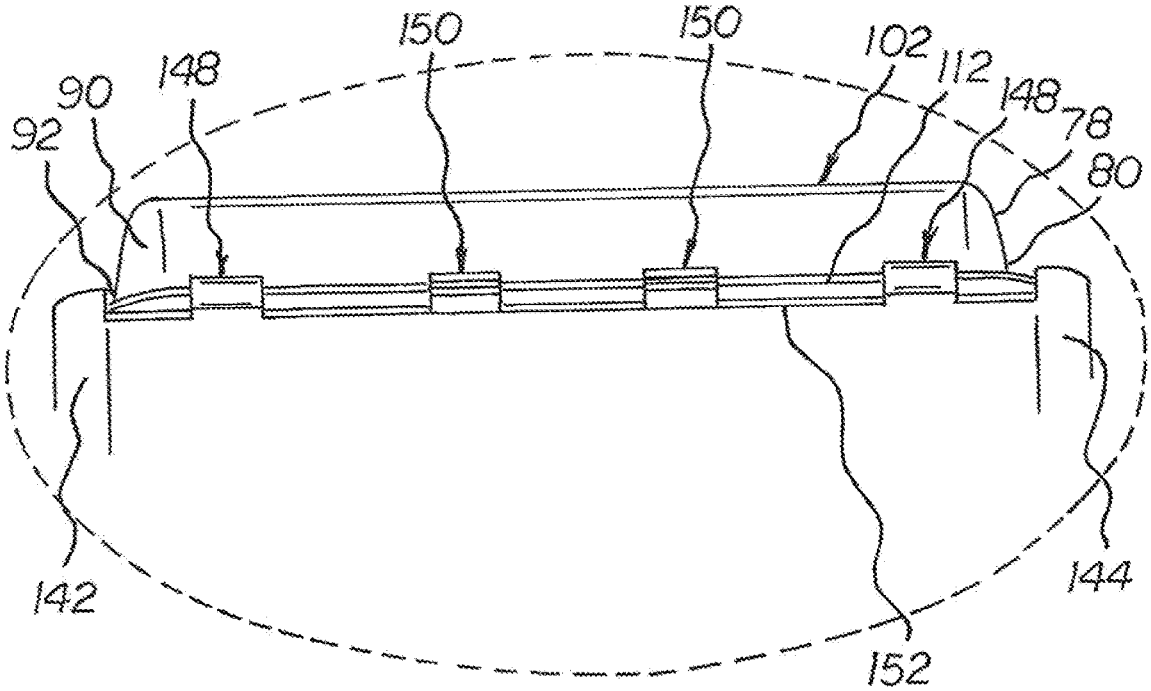
FIG. 7

FIG. 10
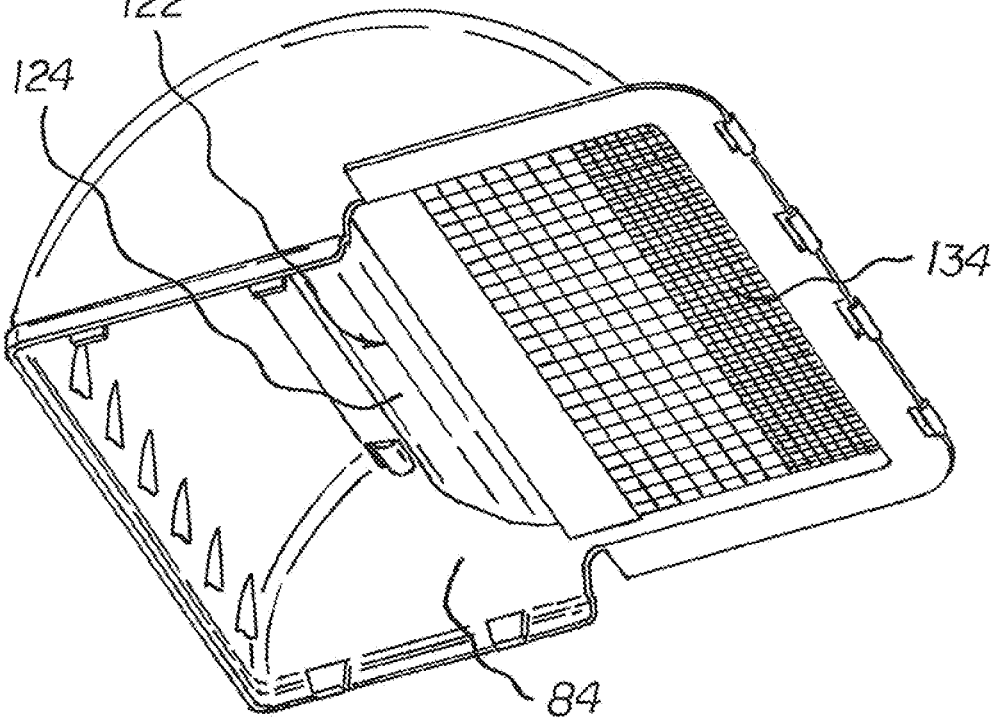
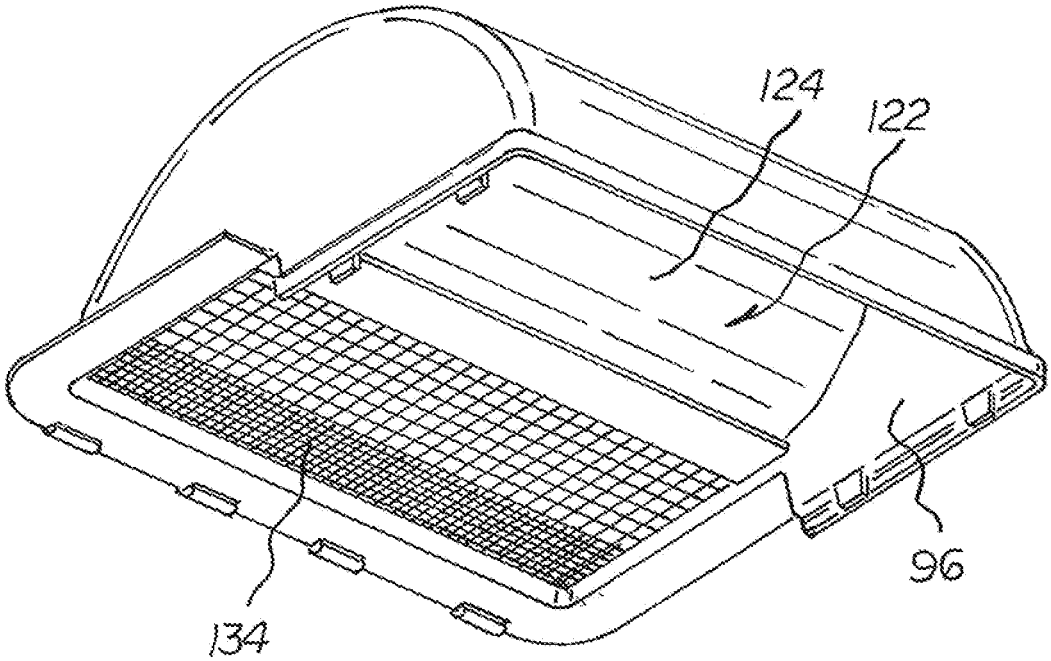
FIG. 11

FIG. 12
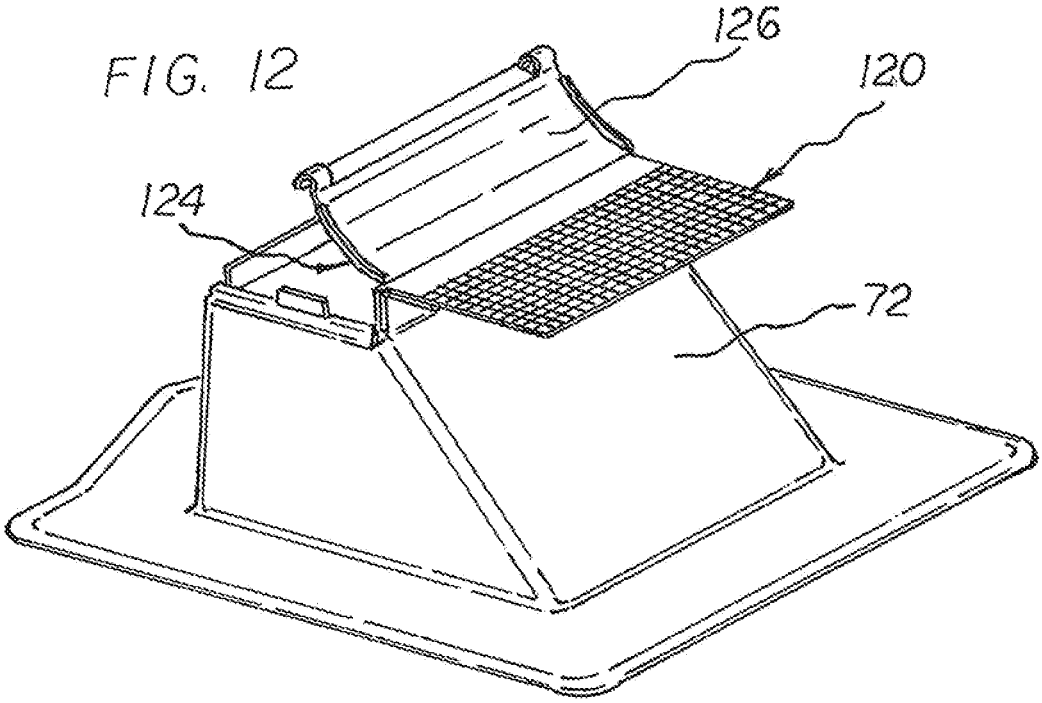
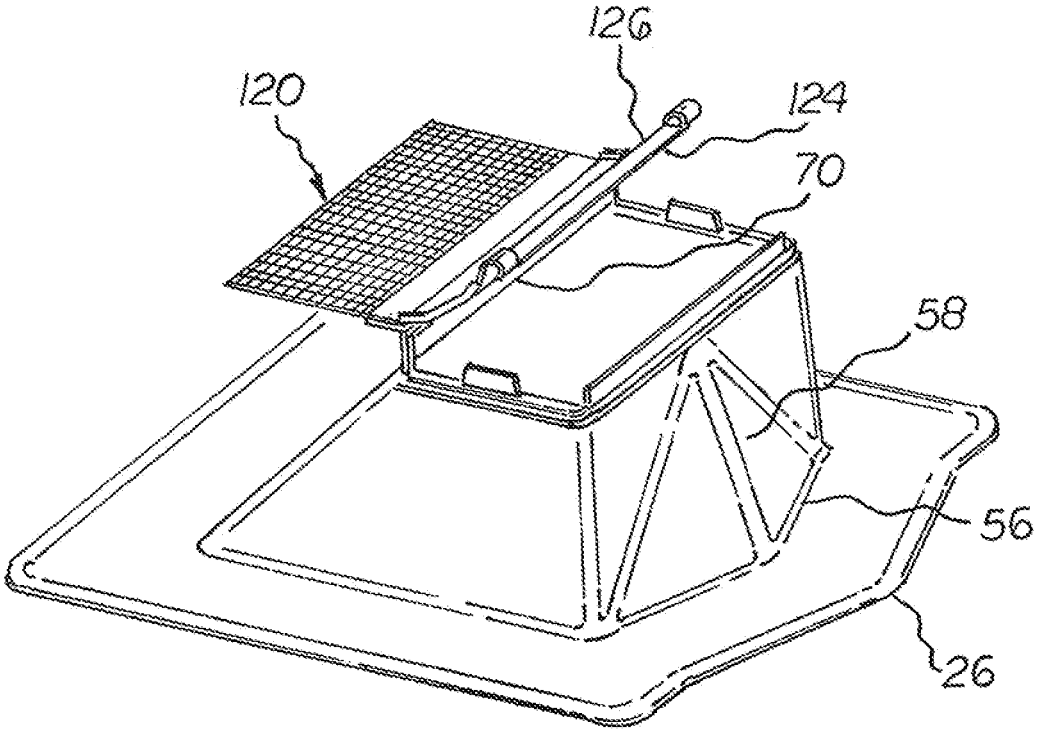
FIG. 13

ROOF VENT

RULE 1.78(F) (1) DISCLOSURE

The Applicant has submitted a related pending or patented non-provisional application within two months of the filing date of this present application. The invention is made by a single inventor, so there are no other inventors to be disclosed. This application is not under assignment to any other person or entity at this time.

The related application which are direct to, or related to, the present application is application Ser. No. 17/725,646, which was filed on Apr. 21, 2022. The present application is a continuation in part of the Ser. No. 17/725,646 application and the present application claims the priority of the Ser. No. 17/725,646 application which was filed on Apr. 21, 2022.

BACKGROUND OF THE INVENTION

There is no research of development of this application which is federally sponsored.

Field of the Invention

The present invention relates to a Roof Vent and more particularly pertains to Roof Vent having a movable flap.

Description of the Prior Art

The use of a Roof Vent is known in the prior art. More specifically, a Roof Vent, previously devised and utilized for the purpose of venting the roof of a structure is well known to consist basically of familiar, expected, and obvious structural configurations, notwithstanding the number of designs encompassed by the prior art which has been developed for the fulfillment of countless objectives and requirements.

While the prior art devices fulfill their respective, particular objectives and requirements, the prior art does not describe Roof Vent that allows for a Roof Vent having a movable flap.

In this respect, the Roof Vent, according to the present invention, substantially departs from the conventional concepts and designs of the prior art, and in doing so provides an apparatus primarily developed for the purpose of providing a Roof Vent having a movable flap.

Therefore, it can be appreciated that there exists a continuing need for a new and improved Roof Vent which can be used for venting the roof of a structure. In this regard, the present invention substantially fulfills this need.

SUMMARY OF THE INVENTION

In view of the foregoing disadvantages inherent in the known types of a Roof Vent now present in the prior art, the present invention provides an improved Roof Vent. As such, the general purpose of the present invention, which will be described subsequently in greater detail, is to provide a new and improved Roof Vent and method which has all the advantages of the prior art and none of the disadvantages.

In describing this invention, the word "coupled" is used. By "coupled" is meant that the article or structure referred to is joined, either directly, or indirectly, to another article or structure. By "indirectly joined" is meant that there may be an intervening article or structure imposed between the two articles which are "coupled". "Directly joined" means that the two articles or structures are in contact with one another or are essentially continuous with one another.

In describing aspects of the invention, the word "generally" may be used. The term, "generally" when used to describe a configuration means that the configuration includes those aspects which are within normal manufacturing parameters of acceptance. By way of example, the term "generally round" may be used. This should be interpreted to mean that the configuration may be perfectly round, but may also have a radius which is not exact, but is within the manufacturing parameters. For example, a basketball may be generally round, but not be perfectly round.

By adjacent to a structure is meant that the location is near the identified structure.

To attain the stated objectives and goals, the present invention essentially comprises a rotating flap roof vent comprises several components, in combination.

There is a base. The base has an upper surface and a lower surface with a thickness there between. The base has a forward edge and a pair of parallel side edges, being a left side edge and a right side edge, and a rearward edge. The rearward edge has rearward extension having a chevron configuration. The base has an air passageway there through.

There is a stack. The stack has a pair of upwardly directed side walls, being a left side wall. The left side wall of the stack has an upper extent and a lower extent with a first height there between. The first height of the left side wall of the stack is measured in a direction perpendicular from the upper surface of the base. The left side wall of the stack has an inner surface and an outer surface with a thickness there between.

The stack has a right side wall. The right side wall of the stack has an upper extent and a lower extent with the first height there between. The first height of the right side wall of the stack is measured in a perpendicular direction from the upper surface of the base. The right side wall of the stack has an inner surface and an outer surface, with a thickness there between.

The stack has an upwardly directed rear wall. The rear wall has an upper extent and a lower extent with the first height there between. The height of the rear wall of the stack is measured in a perpendicular direction from the upper surface of the base. The rear wall of the stack has a rearwardly projecting portion forming a cricket. The rear wall of the stack has an inner surface and an outer surface, with a thickness there between.

The stack has a forward wall. The forward wall of the stack has an upper extent and a lower extent with the first height there between. The height of the forward wall of the stack is measured in a perpendicular direction from the upper surface of the base. The forward wall of the stack is upwardly and inwardly directed. The forward wall of the stack has an inner surface and an outer surface, with a thickness there between.

The stack has an air passageway there through. The lower extent of the right side wall of the stack and the lower extent of the left side wall of the stack and the lower extent of the rear wall of the stack and the lower extent of the forward wall of the stack each being continuous with the upper surface of the base. The stack air passageway is defined by the inner surfaces of the right side wall of the stack and the left side wall of the stack and the forward wall of the stack and the rearward wall of the stack.

There is a dome. The dome has an arcuate configuration. The dome has a pair of upwardly directed side walls, being a dome right side wall, having a lower extent and an upper extent with a second height there between. The right side wall of the dome has an inner surface and an outer surface with a thickness there between. The right side wall inner surface of the dome has at least one baffle mounting protrusion thereon.

The dome has a left side wall. The left side wall of the dome has a lower extent and an upper extent with the second height there between. The left side wall of the dome has an inner surface and an outer surface with a thickness there between. The left side wall inner surface of the dome has at least one baffle mounting protrusion there on.

The dome has an arcuately configured top. The arcuately configured top of the dome has an inner surface and an outer surface, with a thickness there between. The arcuately configured top of the dome has a rearward edge and forward edge, with a first arcuately configured length there between.

The rearward edge of the dome is continuous with the upper extent of the rear wall of the stack. The lower extent of the right side surface of the dome is continuous with the upper extent of the right side wall of the stack. The lower extent of the left side surface of the dome being continuous with the upper extent of the left side wall of the stack.

The forward edge of the top of the dome has a outwardly extending flange. The flange of the forward edge of the top of the dome has a right side portion, a left side portion, and a forward portion. The forward portion of the flange of the top of the dome has a plurality of hinge holes there through.

There is an internal baffle. The internal baffle has a curved configuration, with an inner surface, an outer surface, and a thickness there between. The internal baffle has a pair of mounting hooks for coupling the baffle to the at least one baffle mounting protrusion of the left dome side wall interior surface and to the at least one baffle mounting protrusion of the right dome side wall interior surface.

There is a screen. The screen has an L-shaped configuration with a rearward leg having a second length. The second length of the rearward leg of the screen is downwardly disposed. The screen has a forward leg having a third length. The forward leg of the screen has a rectilinear configuration. The third length of the forward leg of the screen is greater than the second length of the rearward leg of the screen.

The screen forward leg has a rearward mesh portion and a forward mesh portion. The forward mesh portion of the screen has a mesh being in the range of one hundred openings per square inch and four hundred openings per square inch and the rearward mesh portion having a mesh being in the range of twenty five openings per square inch and sixty four openings per square inch. The screen is located in the opening formed between the forward edge of the top of the dome and the upper extent of the forward wall of the stack.

There is a flap. The flap has a C-shaped configuration with a left side extension, a right side extension, and a forward portion having a rectilinear configuration. The flap is fabricated of a flexible material. The flap forward portion has two pairs of fixed curved hinges, being a first pair of fixed curved hinges and a second pair of fixed curved hinges. The flap is rotatably movable about the two pairs of fixed curved hinges.

The flap forward portion has a rearward edge. The rearward edge of the forward portion of the flap has the plurality of fixed curved hinges.

The first pair of the fixed curved hinges each have a rearwardly directed C-shaped configuration with a rearwardly directed opening. Each of the first pair of fixed curved hinges has a rearwardly directed stop extension to limit flap movement.

The second pair of fixed curved hinges each have a forwardly directed C-shaped configuration with a forwardly directed opening. The pairs of fixed curved hinges of the forward portion of the flap have opposed openings with the orientation of the openings being described when the flap is in a downward orientation.

The fixed curved hinges of the flap forward portion are configured to be received by and mated with the plurality of hinge holes of the forward portion of the flange of the top of the dome, so as to allow the flap to move from an open orientation to a closed orientation. The flap fixed curved hinges are configured to allow the flap to rotate through an arc having the range of minus thirty degrees and positive ninety degrees measured from a line perpendicular to the upper surface of the base. The flap fixed curve hinges have opposed openings with the orientation of the openings being described when the flap is in a downward orientation.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved Roof Vent which has all of the advantages of the prior art a Roof Vent and none of the disadvantages.

It is another object of the present invention to provide a new and improved Roof Vent which may be easily and efficiently manufactured and marketed.

It is further object of the present invention to provide a new and improved Roof Vent which is of durable and reliable constructions.

An even further object of the present invention is to provide a new and improved Roof Vent which is susceptible of a low cost of manufacture with regard to both materials and labor, and which accordingly is then susceptible of low prices of sale to the consuming public, thereby making such Roof Vent economically available to the buying public.

Even still another object of the present invention is to provide a Roof Vent for Roof Vent having a movable flap.

Lastly, it is an object of the present invention to provide a new and improved Roof Vent. The Roof Vent has a base having an air passageway there through, coupled to a stack having a pair of side walls and rear wall and a forward wall forming an air passageway. The stack is coupled to the base, and a dome being coupled to the stack. The dome has an air passageway there through. the dome having a plurality of hinge holes there through. The roof vent has a flap which is rotatably coupled to the dome. The flap has a plurality of hinges which couple the flap to the dome.

It should be understood that while the above-stated objects are goals which are sought to be achieved, such objects should not be construed as limiting or diminishing the scope of the claims herein made.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 2 is a perspective left side, and front, view of the Roof Vent.

FIG. 3 is a close up view of the hinges of the Roof Vent.

FIG. 6 is a close up view of the hinges which couple the flap to the flange of the dome. The figure shows the orientations of the openings of the hinges, along with the extensions which act as hinge stops.

FIG. 7 is a front partial elevational view, showing the dome along with the portion of flap which couples the dome and the flap.

FIG. 10 is a bottom forward perspective view of the interior of the dome along with the baffle and the screen in operable position.

FIG. 11 is a bottom rear perspective view of the interior of the dome along with the baffle and the screen in operable position.

FIG. 12 is a forward upper perspective view of the base coupled to the stack, with the dome removed, and the baffle and screen in operable position.

FIG. 13 is a rearward upper perspective view of the base coupled to the stack, with the dome removed, and the baffle and screen in operable position.

The same reference numerals refer to the same parts throughout the various Figures.

DESCRIPTION OF THE PREFERRED EMBODIMENT

Figure 1:
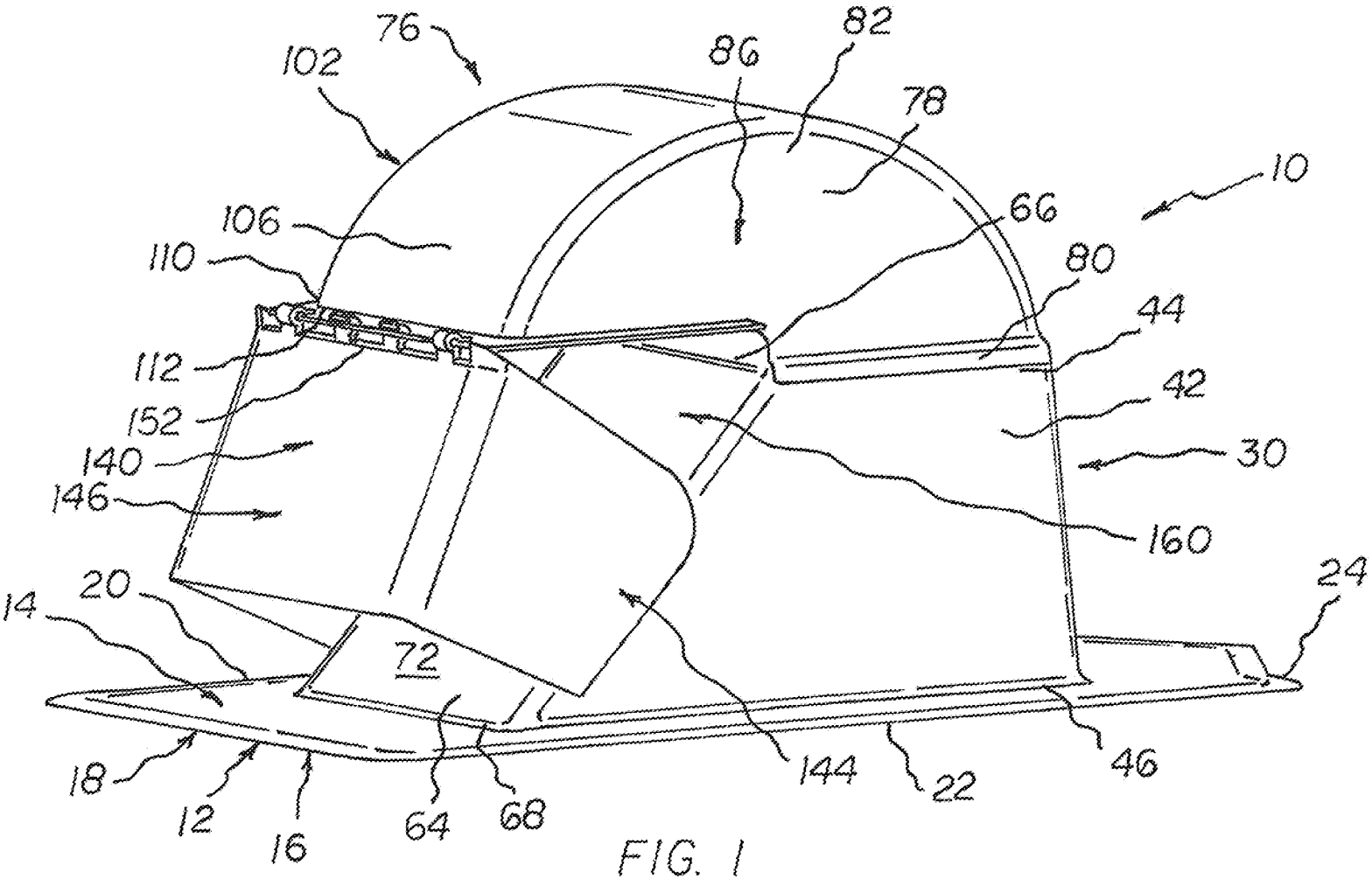
FIG. 1 is a perspective right side view of the Roof Vent.
Figure 4:
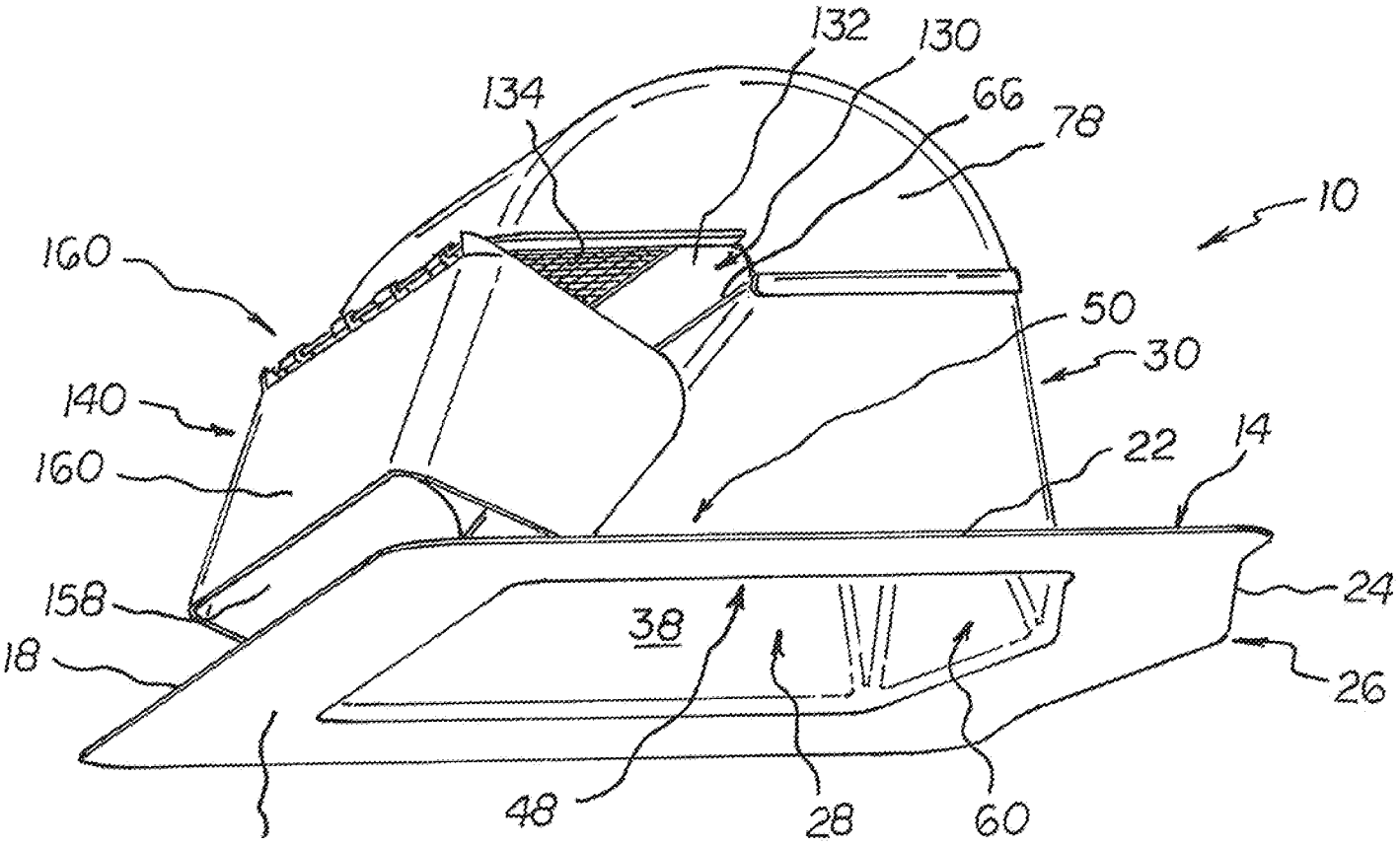
FIG. 4 is a bottom right perspective view of the Roof Vent showing the opening which is continuous through the interior of the Roof Vent.
Figure 5:
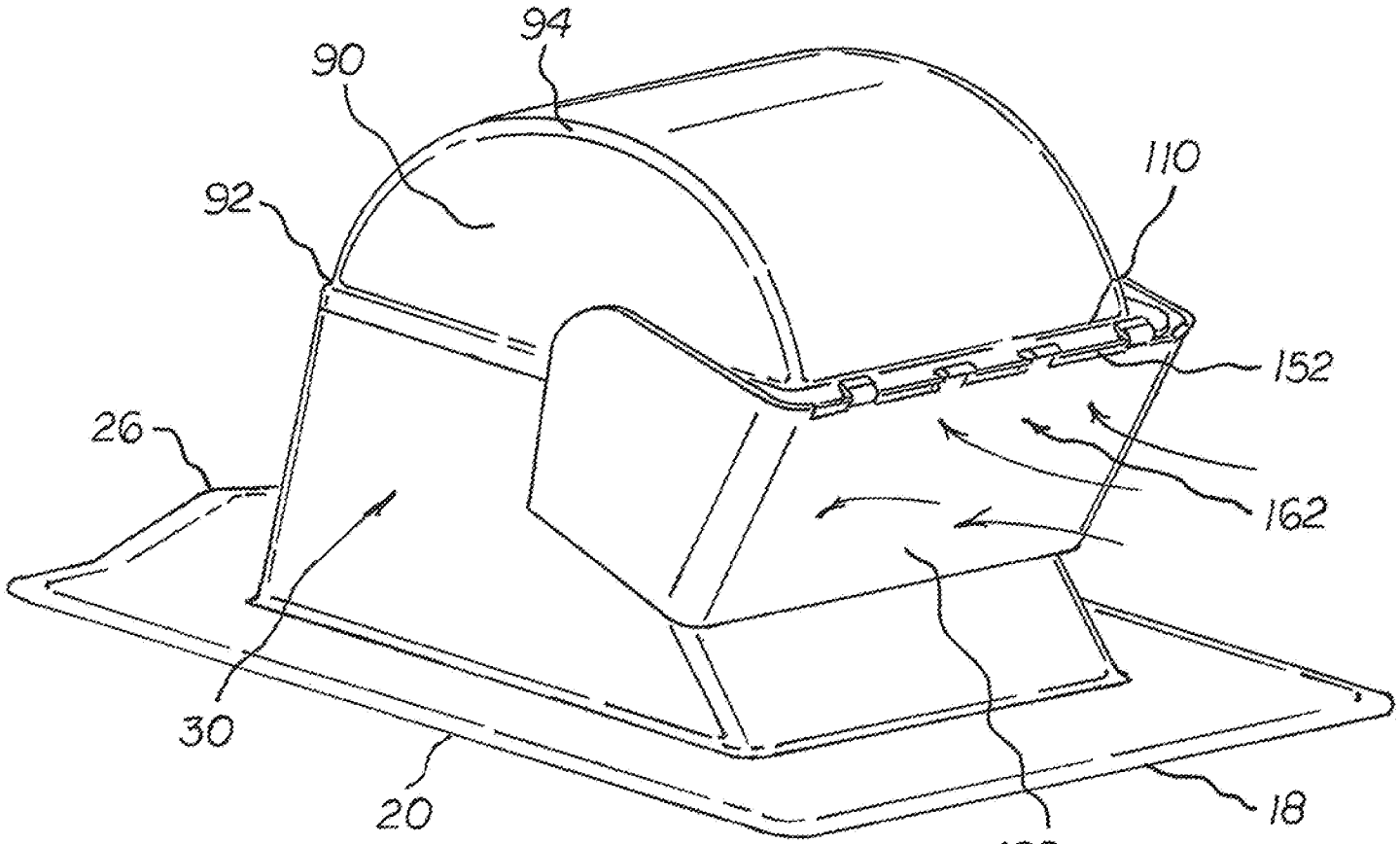
FIG. 5 is a top right perspective view of the Roof Vent showing the flap in the closed orientation, using arrows to illustrate wind flow against the flap, bringing it to a closed orientation.
Figure 8:
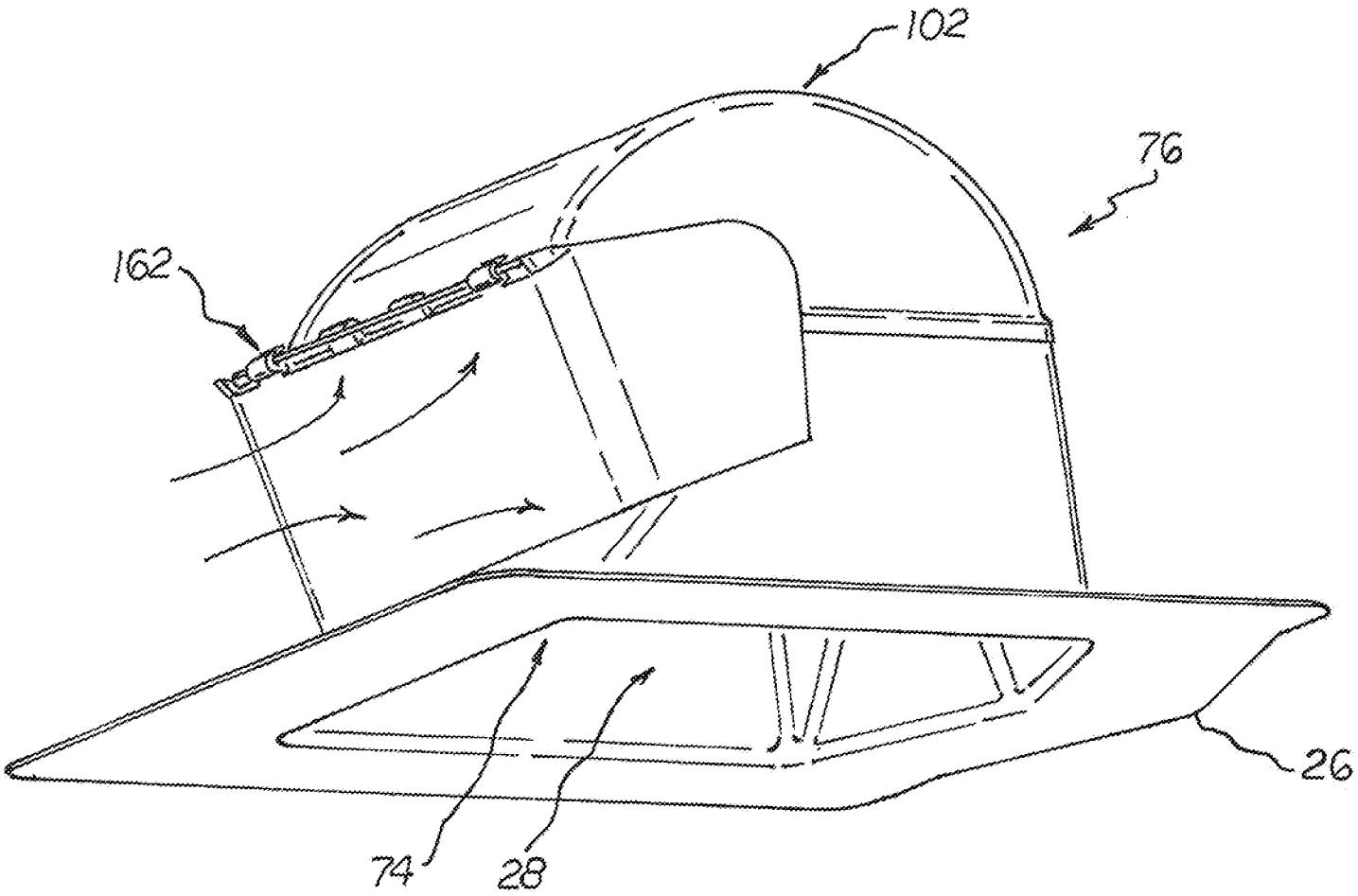
FIG. 8 is a bottom right perspective view, showing the flap in a closed orientation, with arrows indicating wind direction against the flap.
Figure 9:
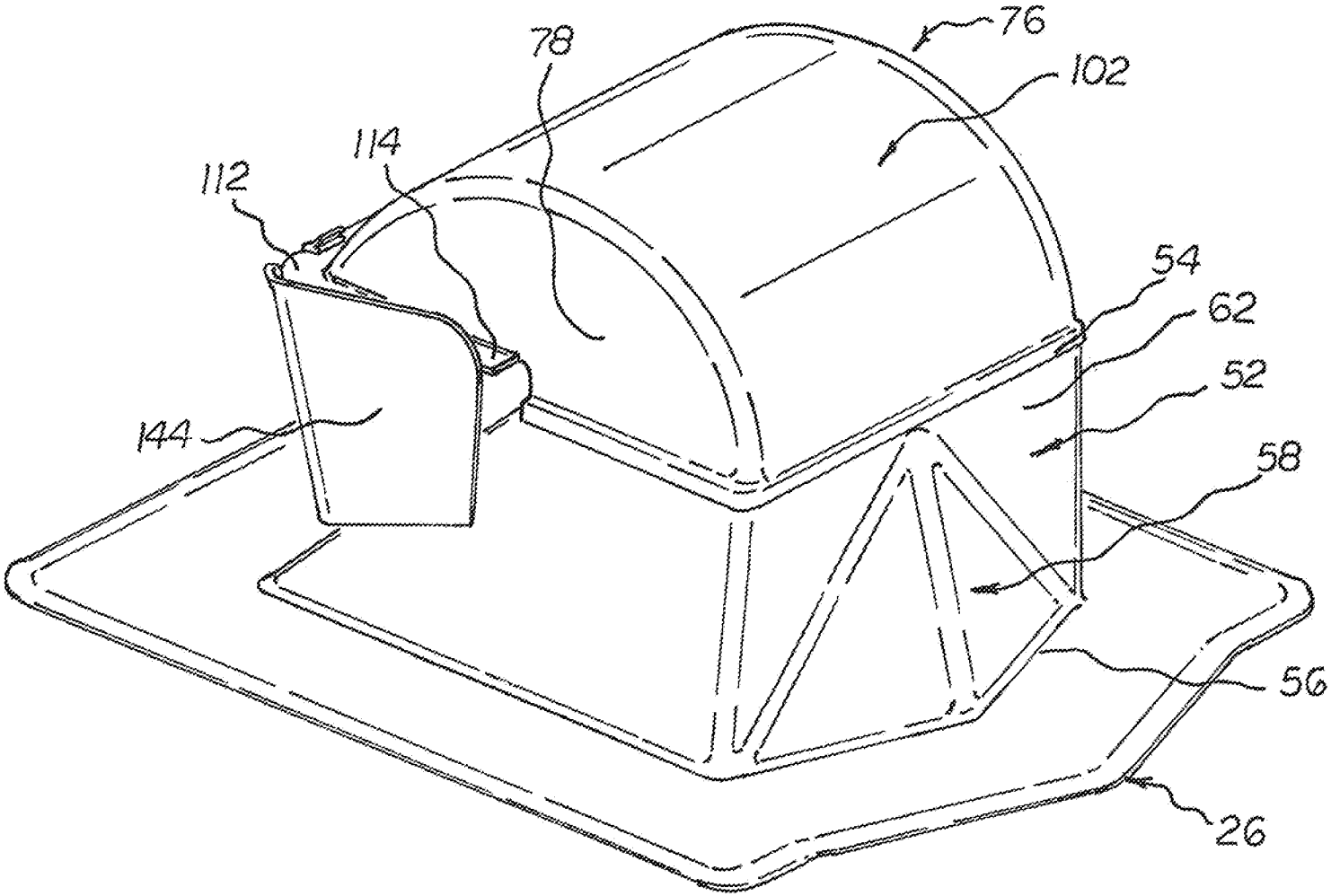
FIG. 9 is a top rear perspective view showing the base chevron configuration and the stack rear wall cricket. Note that the flap is in an open orientation, allowing the easy movement of air from inside the structure to the outside of the structure.
Figure 14:
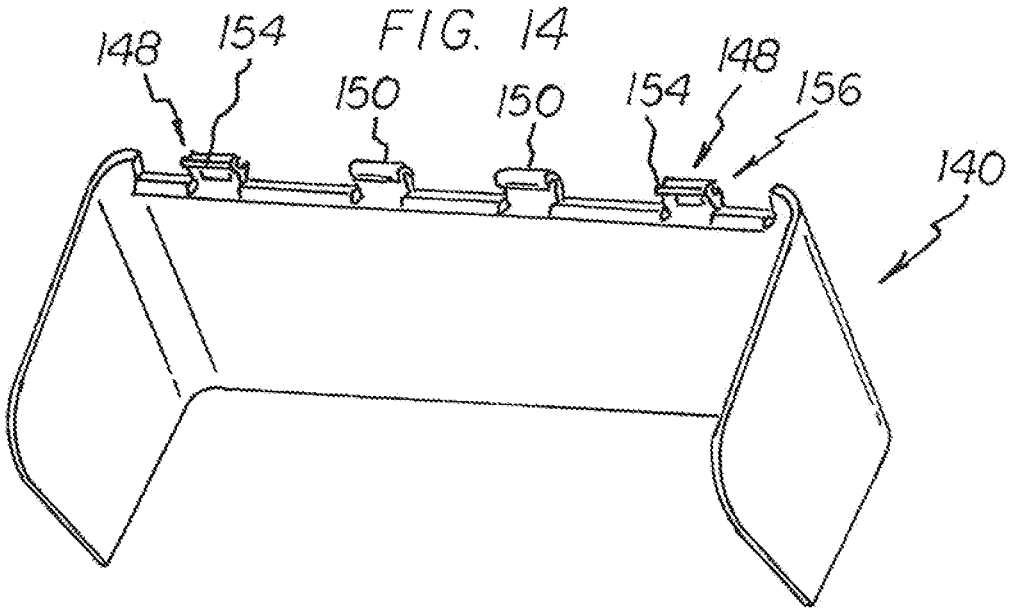
FIG. 14 is a interior perspective view of the flap, showing the side portion and the inner surface of the flap. The hinges are visible on the rearward edge of the flap.
Figure 15:
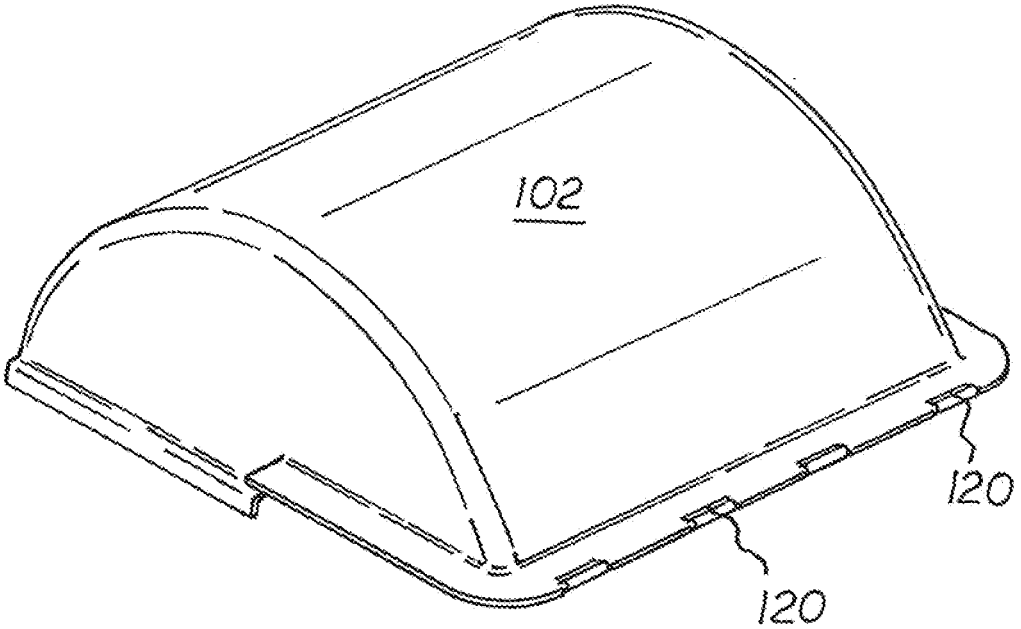
FIG. 15 is a top left perspective view of the exterior of the dome, showing the forward flange with hinge holes.
Figure 16:
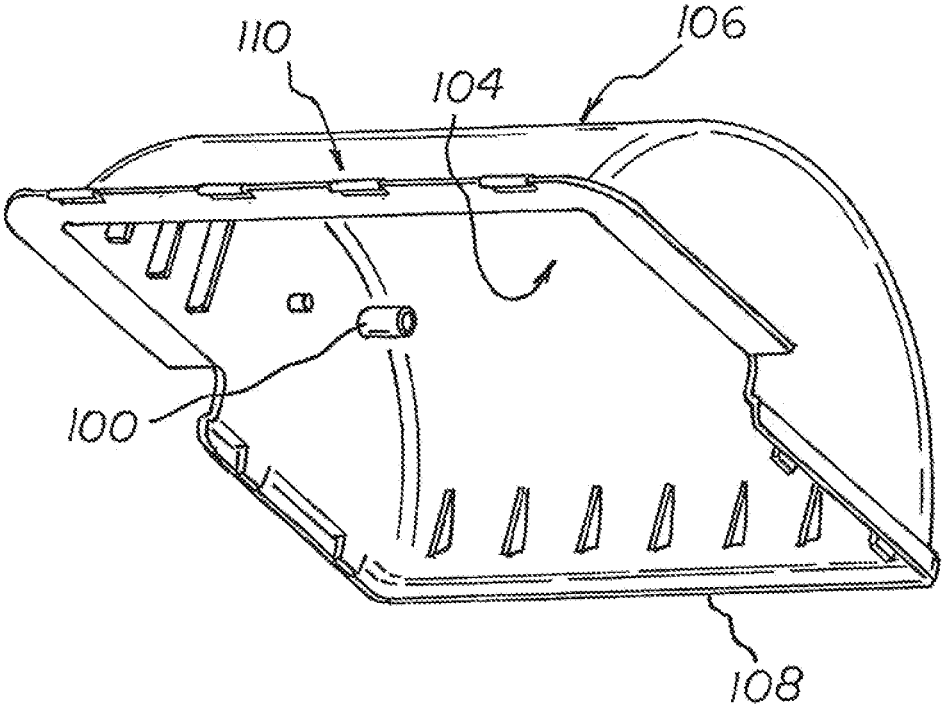
FIG. 16 is a lower right perspective view of the interior of the dome. Note the protuberance for mounting the baffle, located on the inner surface of the left side wall of the dome.
Figure 17:
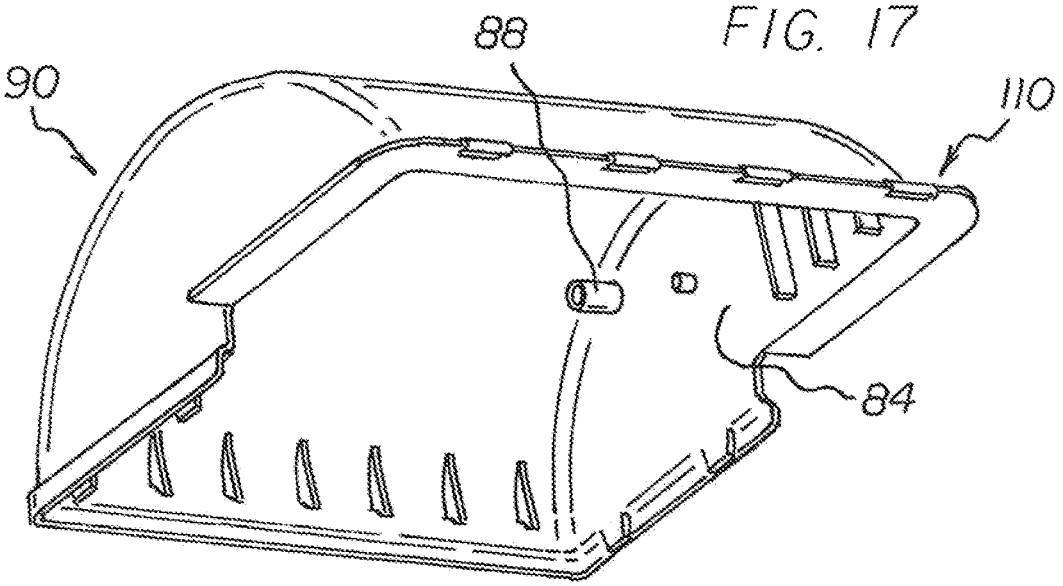
FIG. 17 is a lower left perspective view of the interior of the dome. Note the protuberance for mounting the baffle, located on the inner surface of the right side wall of the dome.
Figure 18:
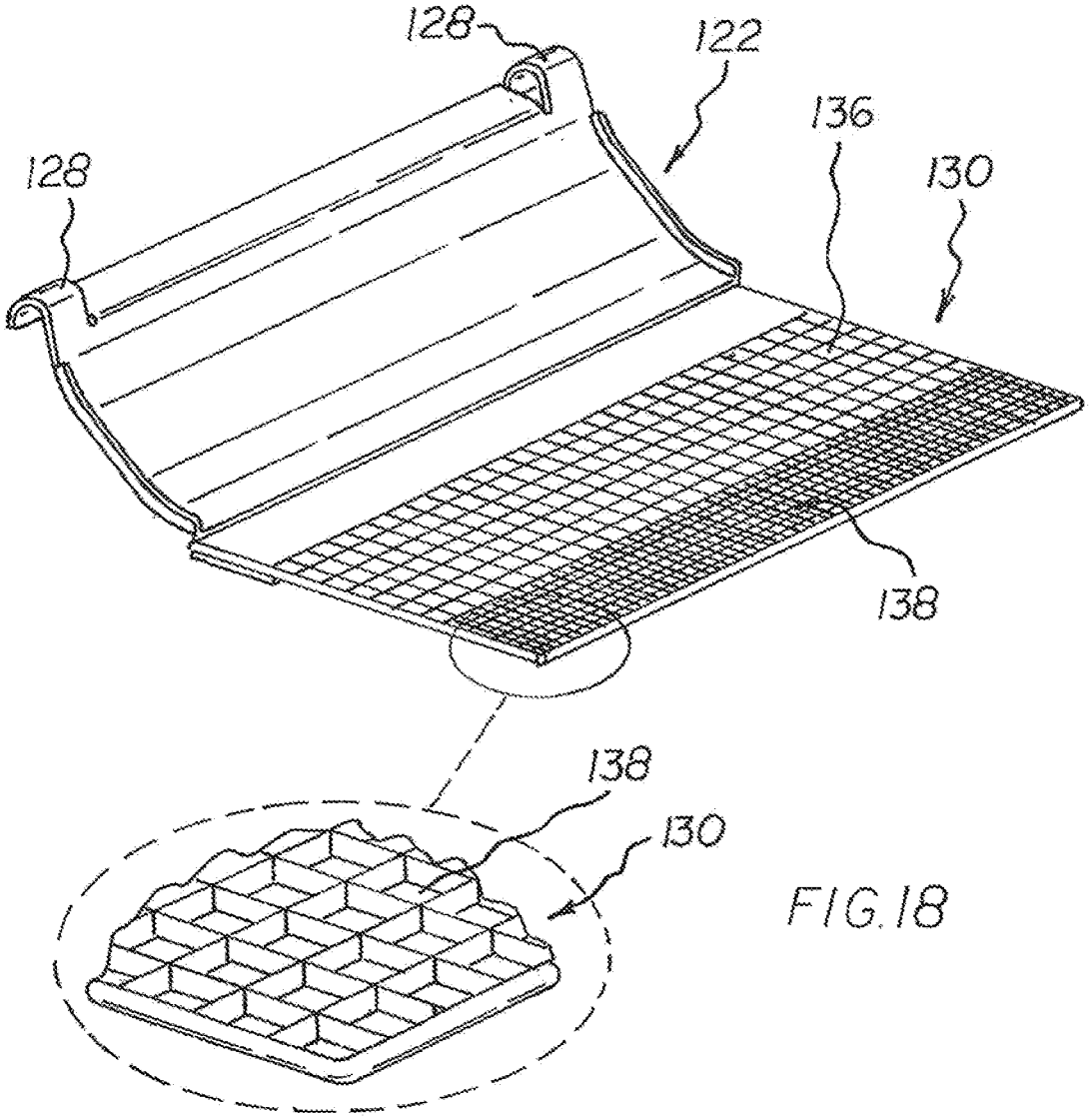
FIG. 18 is a top perspective view of the baffle and the screen, as they are oriented in operable position. There is a close up view of the mesh of the screen.

With reference now to the drawings, and in particular to FIG. 1 thereof, the preferred embodiment of the new and improved Roof Vent embodying the principles and concepts of the present invention and generally designated by the reference numeral 10 will be described.

The present invention, the Roof Vent 10 is comprised of a plurality of components. Such components in their broadest context include a base, a stack, a dome and a rotatable flap. Such components are individually configured and correlated with respect to each other so as to attain the desired objective.

A rotating flap roof vent 10 comprises several components, in combination.

There is a base 12. The base has an upper surface 14 and a lower surface 16 with a thickness there between. The base has a forward edge 18 and a pair of parallel side edges, being a left side edge 20, a right side edge 22, and a rearward edge 24. The rearward edge has rearward extension 26 having a chevron configuration. The base has an air passageway 28 there through.

There is a stack 30. The stack has a pair of upwardly directed side walls, being a left side wall 32. The left side wall of the stack has an upper extent 34 and a lower extent 36 with a first height there between. The first height of the left side wall of the stack is measured in a direction perpendicular from the upper surface of the base. The left side wall of the stack has an inner surface 38 and an outer surface 40 with a thickness there between.

The stack has a right side wall 42. The right side wall of the stack has an upper extent 44 and a lower extent 46 with the first height there between. The first height of the right side wall of the stack is measured in a perpendicular direction from the upper surface of the base. The right side wall of the stack has an inner surface 48 and an outer surface 50, with a thickness there between.

The stack has an upwardly directed rear wall 52. The rear wall has an upper extent 54 and a lower extent 56 with the first height there between. The height of the rear wall of the stack is measured in a perpendicular direction from the upper surface of the base. The rear wall of the stack has a rearwardly projecting portion forming a cricket 58. The rear wall of the stack has an inner surface 60 and an outer surface 62, with a thickness there between.

The stack has a forward wall 64. The forward wall of the stack has an upper extent 66 and a lower extent 68 with the first height there between. The height of the forward wall of the stack is measured in a perpendicular direction from the upper surface of the base. The forward wall of the stack is upwardly and inwardly directed. The forward wall of the stack has an inner surface 70 and an outer surface 72, with a thickness there between.

The stack has an air passageway 74 there through. The lower extent of the right side wall of the stack and the lower extent of the left side wall of the stack and the lower extent of the rear wall of the stack and the lower extent of the forward wall of the stack each being continuous with the upper surface of the base. The stack air passageway is defined by the inner surfaces of the right side wall of the stack and the left side wall of the stack and the forward wall of the stack and the rearward wall of the stack.

There is a dome 76. The dome has an arcuate configuration. The dome has a pair of upwardly directed side walls, being a dome right side wall 78, having a lower extent 80 and an upper extent 82 with a second height there between. The right side wall of the dome has an inner surface 84 and an outer surface 86 with a thickness there between. The right side wall inner surface of the dome has at least one baffle mounting protrusion 88 thereon.

The dome has a left side wall 90. The left side wall of the dome has a lower extent 92 and an upper extent 94 with the second height there between. The left side wall of the dome has an inner surface 96 and an outer surface 98 with a thickness there between. The left side wall inner surface of the dome has at least one baffle mounting protrusion 100 there on.

The dome has an arcuately configured top 102. The arcuately configured top of the dome has an inner surface 104 and an outer surface 106, with a thickness there between. The arcuately configured top of the dome has a rearward edge 108 and forward edge 110, with a first arcuately configured length there between.

The rearward edge of the dome is continuous with the upper extent of the rear wall of the stack. The lower extent of the right side surface of the dome is continuous with the upper extent of the right side wall of the stack. The lower extent of the left side surface of the dome being continuous with the upper extent of the left side wall of the stack.

The forward edge of the top of the dome has a outwardly extending flange 112. The flange of the forward edge of the top of the dome has a right side portion 114, a left side portion 116, and a forward portion 118. The forward portion of the flange of the top of the dome has a plurality of hinge holes 120 there through.

There is an internal baffle 122. The internal baffle has a curved configuration, with an inner surface 124, an outer surface 126, and a thickness there between. The internal baffle has a pair of mounting hooks 128 for coupling the baffle to the at least one baffle mounting protrusion of the left dome side wall interior surface and to the at least one baffle mounting protrusion of the right dome side wall interior surface.

There is a screen 130. The screen has an L-shaped configuration with a rearward leg 132 having a second length. The second length of the rearward leg of the screen is downwardly disposed. The screen has a forward leg 134 having a third length. The forward leg of the screen has a rectilinear configuration. The third length of the forward leg of the screen is greater than the second length of the rearward leg of the screen.

The screen forward leg has a rearward mesh portion 136 and a forward mesh portion 138. The forward mesh portion of the screen has a mesh being in the range of one hundred openings per square inch and four hundred openings per square inch and the rearward mesh portion having a mesh being in the range of twenty five openings per square inch and sixty four openings per square inch. The screen is located in the opening formed between the forward edge of the top of the dome and the upper extent of the forward wall of the stack.

There is a flap 140. The flap has a C-shaped configuration with a left side extension 142, a right side extension 144, and a forward portion 146 having a rectilinear configuration. The flap is fabricated of a flexible material. The flap forward portion has two pairs of fixed curved hinges, being a first pair of fixed curved hinges 148 and a second pair of fixed curved hinges 150. The flap is rotatably movable about the two pairs of fixed curved hinges.

The flap forward portion has a rearward edge 152. The rearward edge of the forward portion of the flap has the plurality of fixed curved hinges.

The first pair of the fixed curved hinges each have a rearwardly directed C-shaped configuration with a rearwardly directed opening 154. Each of the first pair of fixed curved hinges has a rearwardly directed stop extension 156 to limit flap movement.

The second pair of fixed curved hinges each have a forwardly directed C-shaped configuration with a forwardly directed opening 158. The pairs of fixed curved hinges of the forward portion of the flap have opposed openings with the orientation of the openings being described when the flap is in a downward orientation.

The fixed curved hinges of the flap forward portion are configured to be received by and mated with the plurality of hinge holes of the forward portion of the flange of the top of the dome, so as to allow the flap to move from an open orientation 160 to the closed orientation. The flap fixed curved hinges are configured to allow the flap to rotate through an arc having the range of minus thirty degrees and positive ninety degrees measured from a line perpendicular to the upper surface of the base. The flap fixed curve hinges have opposed openings with the orientation of the openings being described when the flap is in a downward orientation.

The flap has an inner surface 158 and an outer surface 160.

The current prior art encompasses roof vents without a flap. In windy and rainy conditions, such as those found in thunder storms and hurricanes, the wind can carry water, in large quantities, up into the roof vent, causing roof leakage and damage to roof and wall structure. These instances are usually isolated, and it is difficult to find a roof leak that does not always present itself.

The current invention uses a flexible flap. The flexible flap is used so that the flap may be manipulated so as to allow the opposing hinges to be coupled to the roof vent. The hinges are configured to have a stop, to prevent the flap from rising to an undesired orientation, such as that which could occur in a condition when the wind is from the rear of the flap. The hinge stops keep the forward portion of the flap, to a rotation from a negative thirty degree orientation to a ninety degree orientation.

In the condition were the wind come from a direction in front of the flap, the wind pressure pushes the flap into the closed, or minus thirty degrees orientation, sealing off the opening from the wind and the carried rain, and preventing water intrusion into the roof area. The internal baffle aids the prevention of water or droplet intrusion into the roof space of the building.

In a condition where the wind comes from the sides of the vent, the left or right portion of the flap would catch the wind, and being the flap downward, to a closed orientation. The angle of the wind, relative to the Roof Vent, determines the amount of force generated to push the flap into a closed orientation. A wind direction which is perpendicular to the side of the Roof Vent would generate less closure pressure than a wind coming from a direction at forty five degrees relative to the front of the Roof Vent, the latter producing more pressure to push the flap into the closed orientation. It should be noted that water, or droplet, intrusion is minimal in the condition of a side wind, but the flap closure reduces any chance of water entry all the more.

The roof vent includes a baffle and internal screen. The baffle works to prevent any water intrusion, if the water and wind pressure is great enough to force water past the flap in a closed orientation. The baffle is configured to prevent the water from entering the roof area, and directing the water out to the opening of the vent, allowing it to drain away across the base of the roof vent.

In a wind condition, where the wind approaches the Roof Vent from a direction perpendicular to the rear wall of the Roof Vent, the sides of the flap would catch the wind and open the Roof Vent. As all wind and water is approaching the Roof Vent from the rear wall area, there would be no water or droplet intrusion into the Roof Vent. The passing air would also create a vacuum so as to pull air from the Roof Vent, and the building roof structure. The extensions of the hinges would prevent the flap from lifting to a position more than ninety degrees relative to the upper surface of the base.

The Roof Vent screen acts to prevent the inward migration of flying insects, birds and other animals, such as squirrels, which can cause damage once inside the roof area of a structure. The screen, in the preferred embodiment, has two different mesh counts. In other embodiments, however, a screen with a single mesh may be used.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A rotating flap roof vent comprising, in combination:

a base having an upper surface and a lower surface with a thickness there between, the base having a forward edge and a pair of parallel side edges, being a left side edge and a right side edge, and a rearward edge, the base having an air passageway there through;

a stack having a pair of upwardly directed side walls, the stack having a left side wall with the left side wall of the stack having an upper extent and a lower extent, the stack left side wall having an inner surface and an outer surface with a thickness there between;

the stack having a right side wall having an upper extent and a lower extent, the right side wall of the stack having an inner surface and an outer surface with a thickness there between;

the stack having an upwardly directed rear wall, the rear wall of the stack having an upper extent and a lower extent, the rear wall having an inner surface and an outer surface with a thickness there between;

the stack having a forward wall, the forward wall having an upper extent and a lower extent, the forward wall having an inner surface and an outer surface with a thickness there between;

the lower extent of the right side wall and the lower extent of the left side wall and the lower extent of the rear wall and the lower extent of the forward wall each being continuous with the upper surface of the base, the stack having an air passageway there through;

a dome having an arcuate configuration, the dome having a pair of upwardly directed side walls, being a dome right side wall having a lower extent and an upper extent with a second height there between, the right side wall of the dome having an inner surface and an outer surface with a thickness there between;

the dome having a left side wall having a lower extent and an upper extent with the second height there between, the left side wall of the dome having an inner surface and an outer surface with a thickness there between;

the dome having an arcuately configured top, the arcuately configured top of the dome having an inner surface and an outer surface with a thickness there between, the arcuately configured top of the dome having a rearward edge and forward edge with a first arcuately configured length there between, the forward edge of the dome having a plurality of hinge holes there through;

the inner surface of the dome left side wall and the inner surface of the dome right side wall and the inner surface of the dome arcuately configured top forming an air passageway through the dome, the dome left side wall and the dome right side wall and the dome arcuately configured top being coupled to the stack;

a flap being fabricated of a flexible material, the flap forward portion having two pairs of fixed curved hinges being a first pair of hinges and a second pair of hinges, the first pair of curved hinges each having a stop extension which limits rotation of the flap, the flap being rotatably movable about the two pairs of fixed curved hinges with the hinges being rotatably coupled to a flange of the forward edge of the dome;

the first pair of the fixed curved hinges having a rearwardly directed C-shaped configuration with a rearwardly directed opening, with each of the first pair of fixed curved hinges having the rearwardly directed stop extension to limit flap movement;

the second pair of fixed curved hinges having a forwardly directed C-shaped configuration with a forwardly directed opening, the pairs of fixed curved hinges of the forward portion of the flap having opposed openings with the orientation of the openings being described when the flap is in a downward orientation; and an internal baffle having a curved configuration with an inner surface and an outer surface and a thickness there between, the internal baffle having a pair of mounting hooks for coupling the baffle to the at least one baffle mounting protrusion of the left dome side wall interior surface and to an at least one baffle mounting protrusion of the right dome side wall interior surface.

2. The rotating flap roof vent as described in claim 1, with the rotating flap roof vent further comprising:

the forward edge of the top of the dome having a outwardly extending flange, with the flange having a right side portion and a left side portion and a forward portion, the forward portion of the flange of the top of the dome having the plurality of hinge holes there through; and the flap having a C-shaped configuration with a left side extension and a right side extension and a forward portion having a rectilinear configuration.

3. The rotating flap roof vent as described in claim 2, with the rotating flap roof vent further comprising:

the dome right side wall inner surface having the at least one baffle mounting protrusion thereon;

the dome left side wall inner surface having the at least one baffle mounting protrusion there on; and a screen.

4. The rotating flap roof vent as described in claim 3, with the rotating flap roof vent further comprising:

the stack left side wall having a first height between the upper extent of the left side wall of the stack and a lower extent of the left side wall of the stack, the first height of the left side wall being measured in a direction perpendicular from the upper surface of the base;

the stack right side wall having the first height between the upper extent of the right side wall of the stack and the lower extent of the right side wall of the stack, the first height of the right side wall of the stack being measured in a perpendicular direction from the upper surface of the base;

the stack upwardly directed rear wall having the first height between the upper extent of the rear wall of the stack and the lower extent of the rear wall of the stack, the height of the rear wall being measured in a perpendicular direction from the upper surface of the base;

the stack forward wall having the first height between the lower extent of the forward wall of the stack and the lower extent of the forward wall of the stack, the height of the forward wall being measured in a perpendicular direction from the upper surface of the base; and the screen having an L-shaped configuration with a rearward leg having a second length, the second length of the rearward leg of the screen being downwardly disposed.

5. The rotating flap roof vent as described in claim 4, with the rotating flap roof vent further comprising:

the stack upwardly directed rear wall having a rearwardly projecting portion forming a cricket; and the screen having a forward leg having a third length, the forward leg of the screen having a rectilinear configuration, the third length of the forward leg of the screen being greater than the second length of the rearward leg of the screen.

6. The rotating flap roof vent as described in claim 5, with the rotating flap roof vent further comprising:

the base rearward edge having rearward extension having a chevron configuration;

the stack forward wall being upwardly and inwardly directed; and the screen forward leg having a rearward mesh portion and a forward mesh portion.

7. The rotating flap roof vent as described in claim 6, with the rotating flap roof vent further comprising:

the rearward edge of the dome being continuous with the upper extent of the rear wall of the stack, the lower extent of the right side surface of the dome being continuous with the upper extent of the right side wall of the stack, the lower extent of the left side surface of the dome being continuous with the upper extent of the left side wall of the stack; and the screen forward mesh portion having a mesh being in the range of one hundred openings per square inch and four hundred openings per square inch and the rearward mesh portion having a mesh being in the range of twenty five openings per square inch and sixty four openings per square inch.

8. The rotating flap roof vent as described in claim 7, with the rotating flap roof vent further comprising:

the internal baffle having a curved configuration;

the screen being located in the opening formed between the forward edge of the top of the dome and the upper extent of the forward wall of the stack; and the flap forward portion having a rearward edge with the rearward edge of the flap forward portion having the plurality of fixed curved hinges being received by and rotatably mated with the plurality of hinge holes of the forward portion of the flange of the top of the dome so as to allow the flap to rotate from an open orientation to a closed orientation.

9. A rotating flap roof vent comprising, in combination:

a base having an air passageway there through;

a stack having a pair of side walls and rear wall and a forward wall, the stack having an air passageway there through, the stack being coupled to the base;

a dome being coupled to the stack, the dome having an inner surface with the inner surface forming an air passageway through the dome, the dome having a plurality of hinge holes there through; and a flap being rotatably coupled to the dome, the flap having a plurality of fixed curved hinges which couple the flap to the dome, the flap having two pairs of fixed curved hinges with each of the curved hinges having a stop extension, each of the curved hinges being received by and rotatably mated with the plurality of hinge holes of a flange which is coupled to the dome so as to allow the flap to rotate from an open orientation to a closed orientation, turning through an arc of the range of minus thirty degrees and positive ninety degrees measured from a line perpendicular to the upper surface of the base;

a baffle; and a screen, the baffle and screen being coupled to the dome.

10. The rotating flap roof vent as described in claim 9, with the rotating flap roof vent further comprising:

the flap being fabricated of a flexible material, the two pairs of hinges of the flap being rotatably movable about the hinge holes of the flange of the dome;

a first pair of the fixed curved hinges having a rearwardly directed C-shaped configuration with a rearwardly directed opening, with each of the first pair of fixed curved hinges having the stop extension which is rearwardly directed to limit flap movement; and a second pair of fixed curved hinges having a forwardly directed C-shaped configuration with a forwardly directed opening, the pairs of fixed curved hinges of the forward portion of the flap having opposed openings with the orientation of the openings being described when the flap is in a downward orientation.

* * * * *